US006145945A

United States Patent [19]

Parvin

[11] Patent Number: 6,145,945

[45] Date of Patent: Nov. 14, 2000

[54] DRAWER SLIDE BEARING RETAINER AND GUIDE BLOCK

[75] Inventor: Jackie D. Parvin, Pomona, Calif.

[73] Assignee: Accuride International, Inc., Sante Fe Springs, Calif.

[21] Appl. No.: 09/190,708

[22] Filed: Nov. 12, 1998

[51] Int. Cl.[7] ..... A47B 88/00

[52] U.S. Cl. ..... 312/334.46; 312/334.11; 312/334.17; 312/334.38; 384/21

[58] Field of Search ..... 312/334.1, 334.11, 312/334.16, 334.17, 334.32, 334.33, 334.36, 334.38, 334.44, 334.46, 334.7, 334.8; 384/18, 19, 20, 21

[56] References Cited

U.S. PATENT DOCUMENTS

| | | | |
|---|---|---|---|
| 3,650,578 | 3/1972 | Delvecchio et al. | 312/334.46 X |
| 3,778,120 | 12/1973 | Hagen et al. . | |
| 3,901,565 | 8/1975 | Hagen et al. . | |
| 3,904,254 | 9/1975 | Hagen et al. . | |
| 3,923,347 | 12/1975 | Dean . | |
| 3,937,531 | 2/1976 | Hagen et al. . | |
| 4,200,342 | 4/1980 | Fall . | |
| 4,252,382 | 2/1981 | Thomas | 312/334.17 X |
| 4,272,139 | 6/1981 | Fler . | |
| 4,324,439 | 4/1982 | Hagen et al. . | |
| 4,370,007 | 1/1983 | Fler . | |
| 4,423,914 | 1/1984 | Vander Ley . | |
| 4,469,384 | 9/1984 | Fler et al. . | |
| 4,537,450 | 8/1985 | Baxter . | |
| 4,696,582 | 9/1987 | Kasten . | |
| 4,932,792 | 6/1990 | Baxter . | |
| 4,993,847 | 2/1991 | Hobbs | 312/334.46 X |
| 4,998,828 | 3/1991 | Hobbs . | |
| 5,002,402 | 3/1991 | Parvin | 384/21 |
| 5,033,805 | 7/1991 | Hobbs | 312/334.46 X |
| 5,181,781 | 1/1993 | Wojcik . | |
| 5,181,782 | 1/1993 | Wojcik . | |
| 5,255,983 | 10/1993 | Parvin . | |
| 5,316,389 | 5/1994 | Hoffman . | |
| 5,466,060 | 11/1995 | Hoffman . | |
| 5,577,821 | 11/1996 | Chu | 312/334.8 X |
| 5,671,988 | 9/1997 | O'Neill | 312/334.44 |
| 5,951,132 | 9/1999 | Cirocco | 312/334.46 |

FOREIGN PATENT DOCUMENTS

| | | | |
|---|---|---|---|
| 585037 | 3/1994 | European Pat. Off. | 312/334.44 |
| 1708286 | 1/1992 | U.S.S.R. | 312/334.8 |
| 8100349 | 2/1981 | WIPO | 312/334.8 |
| WO 98/30130 | 7/1998 | WIPO . | |

*Primary Examiner*—Peter M. Cuomo
*Assistant Examiner*—Hanh V. Tran
*Attorney, Agent, or Firm*—Christie, Parker & Hale, LLP

[57] ABSTRACT

An improved bearing retainer and a guide block for use with drawer slides having multiple slide members. The bearing retainer comprises a connecting member and upper and lower flanges, with apertures to house bearings, extending from the top and bottom of the connecting member. Extending from the middle portion of the connecting member is an extending member with a protrusion therein. In the alternative runners connecting the upper and lower flanges to the connecting member, have protrusions therein. The protrusion or protrusions lodges into a recess or recesses in a guide block attached to an intermediate or outer slide member as the bearing retainer approaches the guide block during the disconnect activity. The guide block comprises of stops to halt movement of the bearing retainer towards the guide block and to guide an inner slide member to engage the bearing retainer. Extending from the middle portion of the guide block is a capture member which contains the recess adapted to loosely receive the protrusion on the bearing retainer. In the alternative, receivers between the capture member and the stops of the guide block, contain recesses adapted to loosely receive the protrusions on the runners of the bearing retainer.

9 Claims, 10 Drawing Sheets

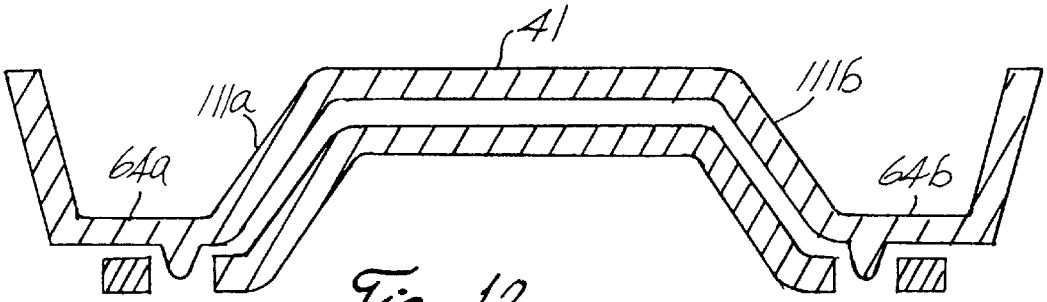
Fig. 12
Fig. 11
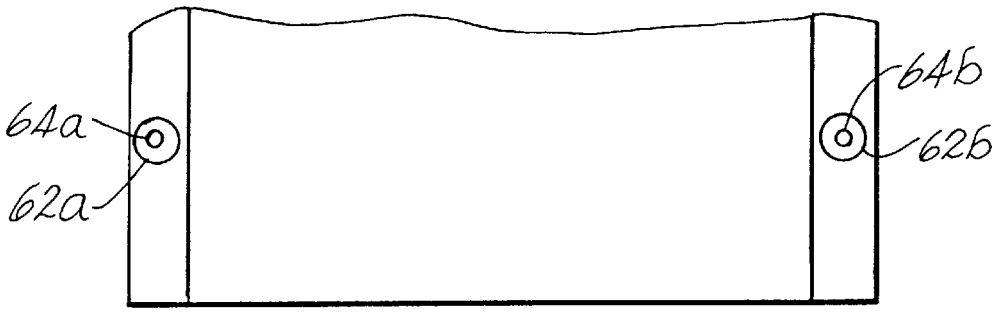

DRAWER SLIDE BEARING RETAINER AND GUIDE BLOCK

BACKGROUND

This invention relates generally to drawer slides, and more particularly to bearing retainer retention devices for drawer slides.

Telescopic slides for file drawers and the like are often desirable for use in cabinets and other rack mounted applications. Such slides permit easy access to the interior of the drawer. The slides maintain the drawer in a horizontal position regardless of how far the drawer is withdrawn from the cabinet. A typical drawer slide has two or three slide members slidably, i.e., rollingly, connected by sets of bearings riding in raceways formed on the slide members. Individual bearings within a set of bearings are often held in relative position to one another by bearing retainers.

One type of drawer slides is a telescopic drawer slide. In a telescopic drawer slide the various slide members comprising the drawer slide are nested within one another and extend in a telescopic manner. Two-element telescopic slides normally include an outer slide member and an inner slide member. For purposes of exposition, the outer slide member is connected to the cabinet or enclosure, although it is recognized that the inner slide member may instead be so connected. When the outer slide member is connected to the cabinet or enclosure, the slide member affixed to the drawer is the inner slide member. A three-element telescopic slide will additionally normally include an intermediate slide member slidably connected to and between the outer and inner slide members.

Each drawer slide member, whether an outer slide member, inner slide member, or intermediate slide member, generally comprises a vertical web with bearing raceways extending horizontally from upper and lower margins of the vertical web. In addition, for a two-element drawer slide, the bearings slidably connecting the outer and inner slide members are often held by a common bearing retainer. For a three-element drawer slide, the vertically innermost set of bearings, the bearings slideably connecting the inner and intermediate slide members, are also often held by a common bearing retainer. These common bearing retainers generally mirror in shape the drawer slide members. Accordingly, the common bearing retainer also has a vertical web, and flanges extending from the upper and lower margins of the vertical web for retaining bearings.

The outer slide member is generally fixedly attached, by screws or other means, to the cabinet and the inner slide member is also fixedly attached to the drawer. Often a mechanism is provided so that the inner slide member can be disconnected from the outer slide member so that the drawer may be entirely removed from the cabinet. This mechanism must also allow the drawer to be reinserted into the cabinet, which requires that the inner slide member be reinserted within the outer slide member. The process of reinserting the inner slide member within the outer slide member is more easily accomplished if the bearing retainer is maintained in a position near the forward end of the outer slide member, which is towards the cabinet opening, so that the bearings held by the bearing retainer may serve as insertion guides for the slide member. In addition, if the bearing retainer is not maintained in such a position then misalignment of the inner slide member with respect to the outer slide member during the reinsertion process may result in inadvertent contact between the inner slide member and the bearing retainer. As the inner slide member tends to be of a significantly greater thickness than the bearing retainer, this contact may well result in damage to the bearing retainer. Accordingly, maintaining the bearing retainer at the forward of the outer slide member when the inner slide member is detached from the outer slide member is desirable.

A common method of attachment of the outer slide member to the cabinet is to provide screw holes in the vertical web of the outer slide member, and to use the screw holes to mount the slide to the cabinet. In a similar fashion the inner slide member may be mounted to the drawer. Such a method of mounting a slide member to a cabinet or drawer is, however, not free of problems. Accessing the screw holes when the slide is not extended is often difficult. Access to the screw holes of the outer slide member is impeded by the inner slide member when the web of the outer slide member is placed against the cabinet. Similarly, access to the screw holes of the inner slide member is impeded by the outer slide member when the web of the inner slide member is placed against the drawer. With the inner slide member extended such difficulty may be alleviated, but the extended slide may be inadvertently damaged or possibly cause injury to persons due to its projecting nature. Extending the inner drawer slide also requires greater work space for attaching the drawer slide due to the extended inner slide member stretching out from confines of the cabinet or enclosure. Furthermore, an extended drawer slide acts as a lever arm. The weight of the extended drawer slide causes the drawer slide to pivot around an attachment point. This pivoting can cause tilting in the drawer slide as it is being attached and thereby result in misaligned mounting of the drawer slide.

Other methods of attachment are also possible, but these other methods also present problems. For example, a flange may be integrally formed on the outer slide member, the flange having screw holes for mounting the flange to the cabinet. Alternatively, a mounting bracket may also be welded to the outer slide member, the mounting bracket also having screw holes for similarly mounting the mounting bracket to the cabinet. Use of the integrally formed flange or of the mounting bracket, however, requires the use of additional material and requires additional manufacturing steps, thereby increasing the cost of the drawer slide. In addition, the flange and the mounting bracket increase the size, or footprint, of the drawer slide, which may also be undesirable.

Moreover, attachment of the drawer slide to the cabinet and the drawer is often performed separately, with the outer and inner slide members only joined after attachment to the cabinet and the drawer, respectively. Accordingly, and as previously stated, the outer and inner members of the drawer slide must also be separable. This separation of the drawer slide allows access to the screw holes of the outer slide member and the screw holes in the inner side member, as well as avoids problems with an extending drawer slide member.

Even if the drawer slide is separated, however, the bearing retainer, holding the ball bearings that slidably connect the slide members, is present. The bearing retainer also blocks access to the screw holes in the vertical web of the outer slide member. Forming apertures in the vertical web of the bearing retainer is one way of providing access to the screw holes. As the vertical web of the bearing retainer is not a load bearing portion of the drawer slide, but instead only serves to maintain the bearings in proper relative position, the access holes may be large.

Even with large access holes, however, the bearing retainer must still be properly positioned with respect to the slide member to allow access to the screw holes. Further, the bearing retainer should be restrained from movement during the mounting procedure as movement of the bearing retainer may result in misalignment of the bearing retainer access holes and the screw holes, even if the apertures in the bearing retainer and slide member are initially aligned. However, some slight amount of play in the restrained bearing retainer is also desirable.

SUMMARY OF THE INVENTION

The present invention provides a drawer slide with an inner slide member and an outer slide member. The inner slide member and the outer slide member each have a vertical web and upper and lower arms forming upper and lower raceways extending generally horizontally from the upper and lower margins of the webs. A plurality of bearings are in rolling engagement with webs, with the bearings disposed and apertures and flanges extending from a vertical web of a bearing retainer. A guide block is affixed to the outer member's vertical web, the guide block including a recesses to receive protrusions of the bearing retainer in loose fitting engagement.

Many of the attendant features of this invention will be more readily appreciated as the same becomes better understood by reference to the following detailed description and considered in connection with the accompanying drawings in which like reference symbols designate like parts throughout.

BRIEF DESCRIPTION OF THE DRAWINGS

FIG. 11 is a bottom view of the upper and lower protrusions of the bearing retainer of FIG. 8 lodged into the upper and lower recesses of the guide block of FIG. 8; and FIG. 12 is a cross-section of the upper and lower protrusions of the bearing retainer of FIG. 8 lodged into the upper and lower recesses of the guide block of FIG. 8.

DETAILED DESCRIPTION

Figure 1:
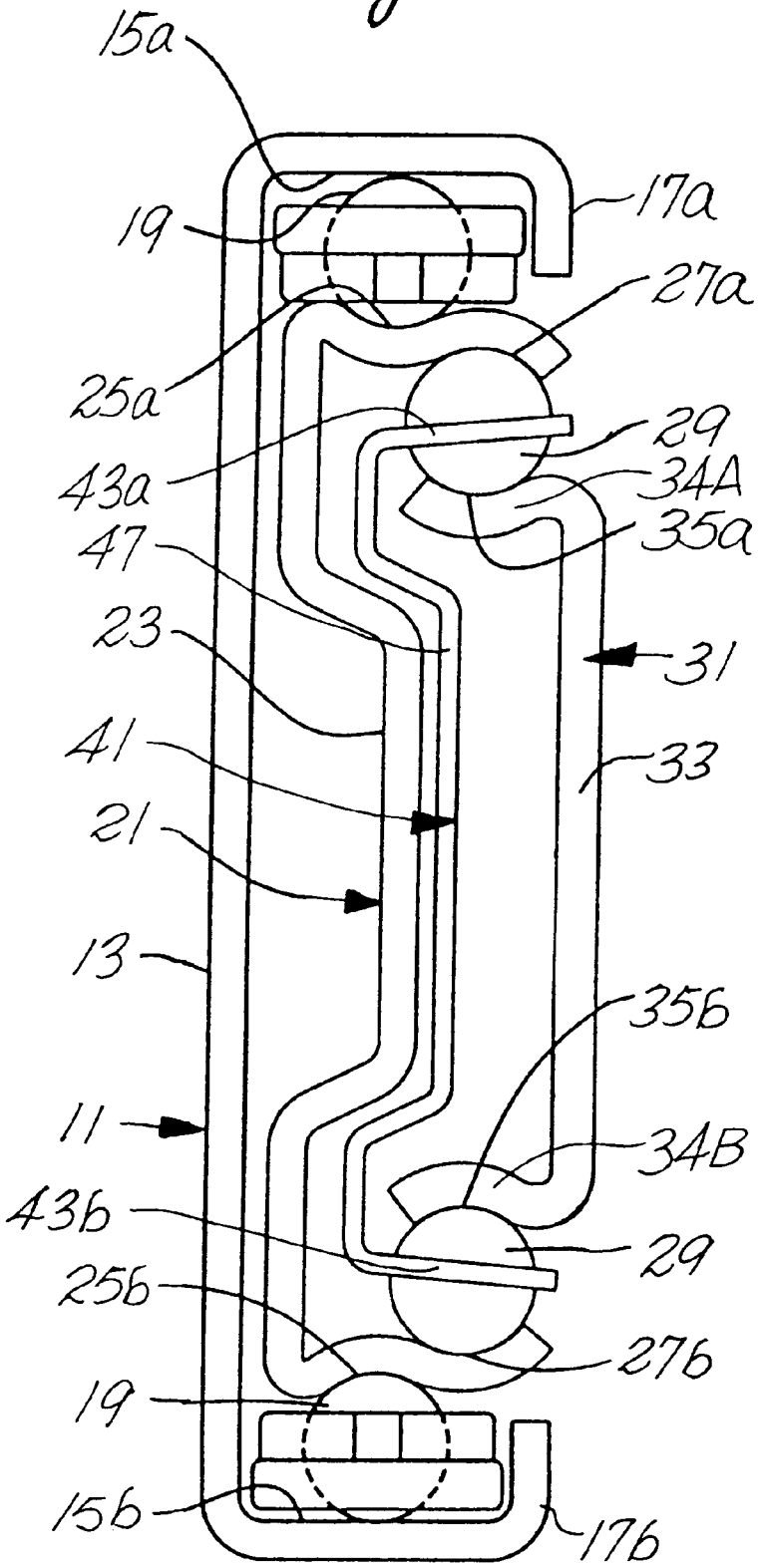
FIG. 1 is a cross-sectional view of a drawer slide.

FIG. 1 illustrates a side view of a telescopic drawer slide. The drawer slide of FIG. 1 is a three element telescopic drawer slide having an outer slide member 11, an intermediate slide member 21, and an inner slide member 31. The outer, intermediate, and inner slide members are slidably connected by bearings 19 and 29, with the intermediate slide member nested within the outer slide member and the inner slide member nested within the intermediate slide member. The slide members are longitudinally extendable from each other. The slide members each have a longitudinal length (not shown in FIG. 1) greatly exceeding a vertical height. As used herein, longitudinal, vertical and horizontal directions are roughly orthogonal and are used for the purposes describing relative positioning of structure of the present invention.

The outer slide member has a vertical web 13. Horizontal arms 15*a,b* extend, in the same direction, from the upper and lower margins of the vertical web 13. Lips 17*a,b* extend vertically inward from the horizontal arms 15*a,b*. The horizontal arms, lips, and vertical web thereby create upper and lower U-channel bearing raceways. The U-channel bearing raceways house, and are in rolling engagement with, upper and lower outer bearings 19.

The outer bearings 19 also are in rolling engagement with bearing raceways of the intermediate slide member. The outer bearings 19, therefore, slidably connect the outer and intermediate slide members. The intermediate slide member has a vertical web 23 and horizontal arms extending from the upper and lower margins of the vertical web 23. The horizontal arms have vertically inward curves proximate the vertical web 23 forming upper and lower vertically outward facing outer bearing raceways 25*a,b* of the intermediate slide member 21. The outer bearings 19 are in rolling engagement the outer bearing raceways 25*a,b*. The vertically inward concave curves of the horizontal arms are followed by vertically outward concave curves forming upper and lower vertically inward facing inner bearing raceways 27*a,b*. Inner bearings 29 are in rolling engagement with the inner bearings raceways 27*a,b* of the intermediate slide member. The inner bearings are held in relative position to one another by a bearing retainer 41.

The inner slide member has a vertical web 33 and horizontal arms 34*a,b* extending from the top and bottom of the vertical web 33. The horizontal arms have vertically inward facing curves forming vertically outward concave bearing raceways 35*a,b*. Inner bearings 29 rollingly engage the vertically outward raceways 35*a,b* of the inner slide member 31.

The bearing retainer 41 has a cross-section substantially similar to that of the intermediate slide member 21. The bearing retainer 41 has a connecting member 47 forming a vertical web, and upper and lower outer flanges 43*a,b* extending horizontally from the upper and lower margins of the connecting member 47. The upper and lower outer flanges 43*a,b* of the connecting member 47 contain apertures (shown in FIG. 2) which house the inner bearings 29.

Figure 2:
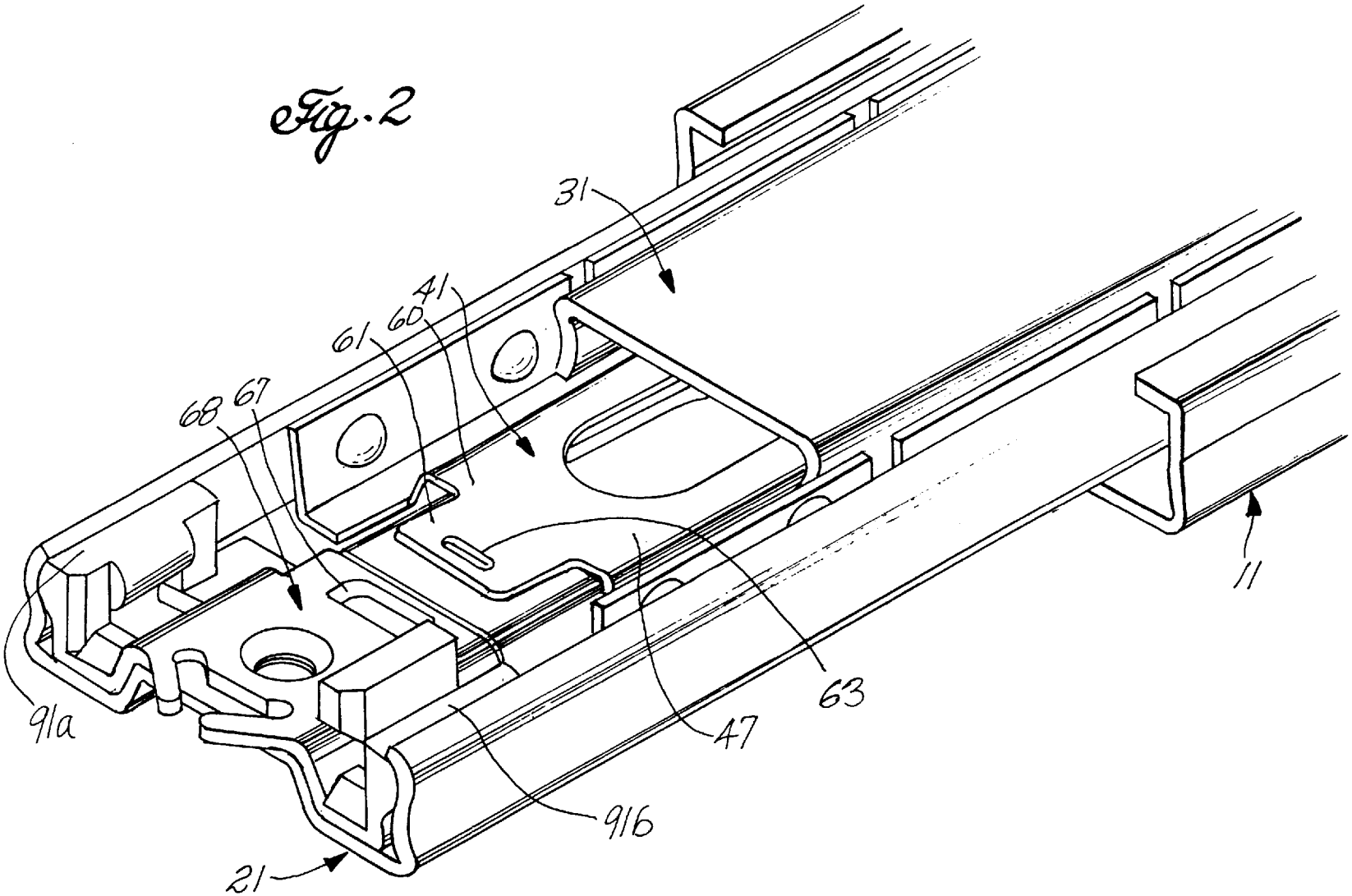
FIG. 2 is a perspective view of a drawer slide illustrating a bearing retainer and guide block of the present invention.

FIG. 2 illustrates a drawer slide having outer, intermediate, and inner slide members. The drawer slide is shown with the intermediate slide member extended from both the inner slide member and the outer slide member, and with a bearing retainer between the inner slide member, and extending therefrom, and the intermediate slide member. Such a configuration with the aforementioned relative slide and bearing retainer positions does not normally occur during operation of the drawer slide, but is illustrated in FIG. 2 to aid in understanding of the invention. The outer slide member is slidably connected to the intermediate slide member 21 as described above with respect to FIG. 1. The intermediate slide member is slidably connected to the inner slide member, also as described above.

A guide block 68 is attached to the intermediate slide member 21. The guide block 68 has a cross-sectional shape similar to that of the intermediate slide member 21. The guide block has a vertical web and upper and lower stops 91*a,* 91*b* horizontally extending from the upper and lower margins of the vertical web.

The bearing retainer 41 is slidably connected to the intermediate slide member 21, as previously described. The bearing retainer has a connecting member 47 forming a vertical web. Extending from a portion of the connecting member 47 along the bearing retainer 41 is a planar extending member 61. A protrusion 63 is on the extending member 61. A recess 67 in the guide block 68 is adapted to receive the protrusion 63. The protrusion 63 on the extending member 61 and the recess 67 on the guide block 68 have somewhat similar shapes.

When the inner slide member is removed from the drawer slide, the inner slide member drags, or carries, the bearing retainer forward over the guide block. As the bearing retainer 41 moves over the guide block, the extending member and, therefore the protrusion, moves over the recess 67. Eventually the protrusion is carried over, and falls into, the recess. Further forward movement of the bearing retainer is prevented by contact between the bearing retainer and the stops, or alternatively between the protrusion and a rear wall 93 (shown in FIG. 4) of the recess.

Figure 3:
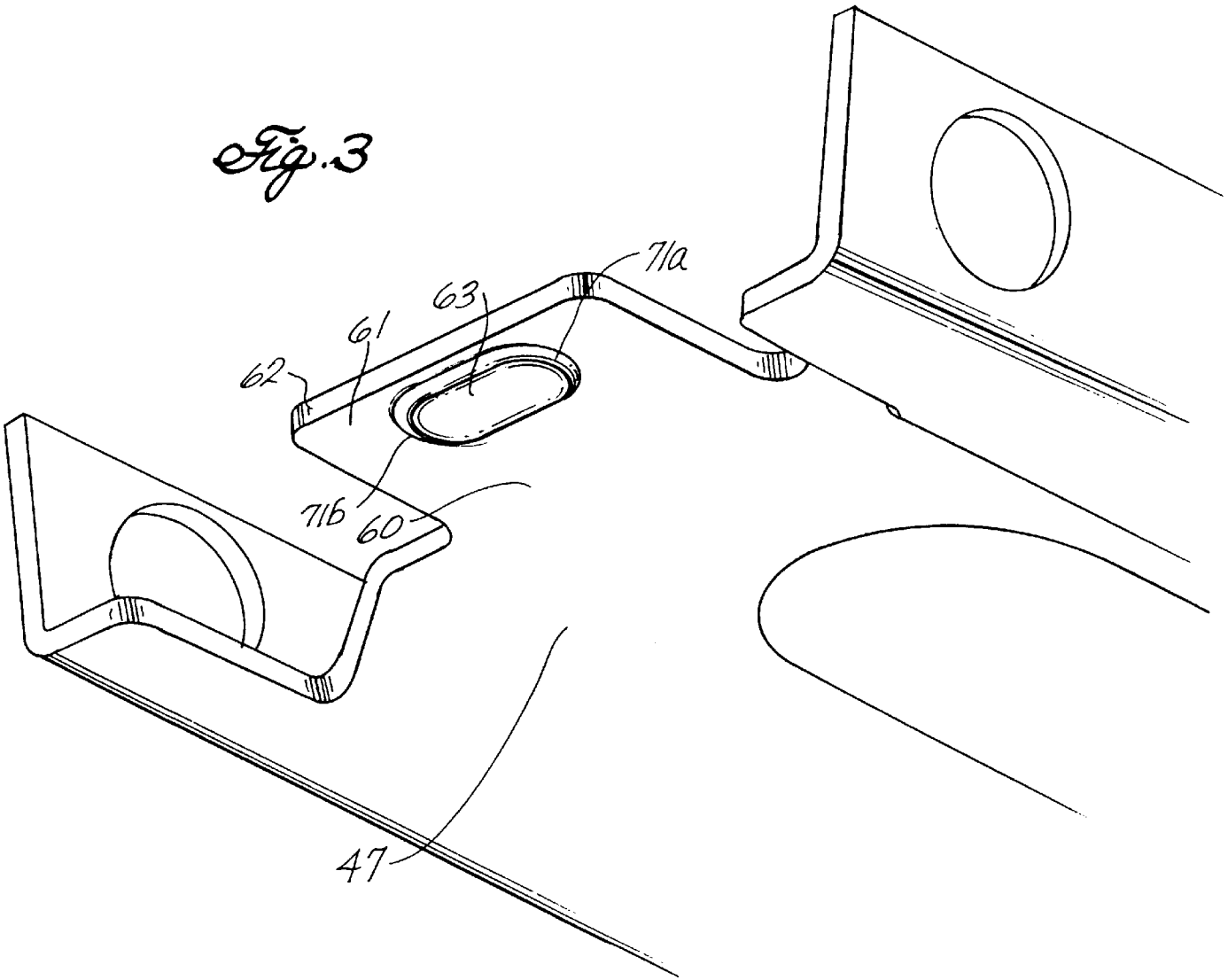
FIG. 3 is a perspective view of the bearing retainer of FIG. 2.

FIG. 3 illustrates the protrusion on the bearing retainer. As previously described, the bearing retainer has a connecting member and upper and lower outer flanges extending from the top and bottom of the connecting member. The extending member 61 extends from the connecting member 47. A rearward portion 60 of the extending member is adjacent the connecting member. A frontal edge 62 of the extending member 61 is distal from the connecting member.

As illustrated in FIG. 3, the protrusion projects from the extending member and towards the outer slide member. The protrusion is oblong in shape, with a width greater than a longitudinal length. The protrusion has rounded edges 71*a, b.* The rounded edges 71*a,b* increase the ease of moving the protrusion 63 past the slight frictional interface caused by contact between the protrusion and the guide block. Conversely, as the bearing retainer is moved away from the guide block 68, the rounded protrusion edges 71*a,b* increase the ease of moving the protrusion out of the recess 67. Additionally, although not shown, the extending member 61 could be removed, with the protrusion projecting from the connecting member 47 of the bearing retainer.

Figure 4:
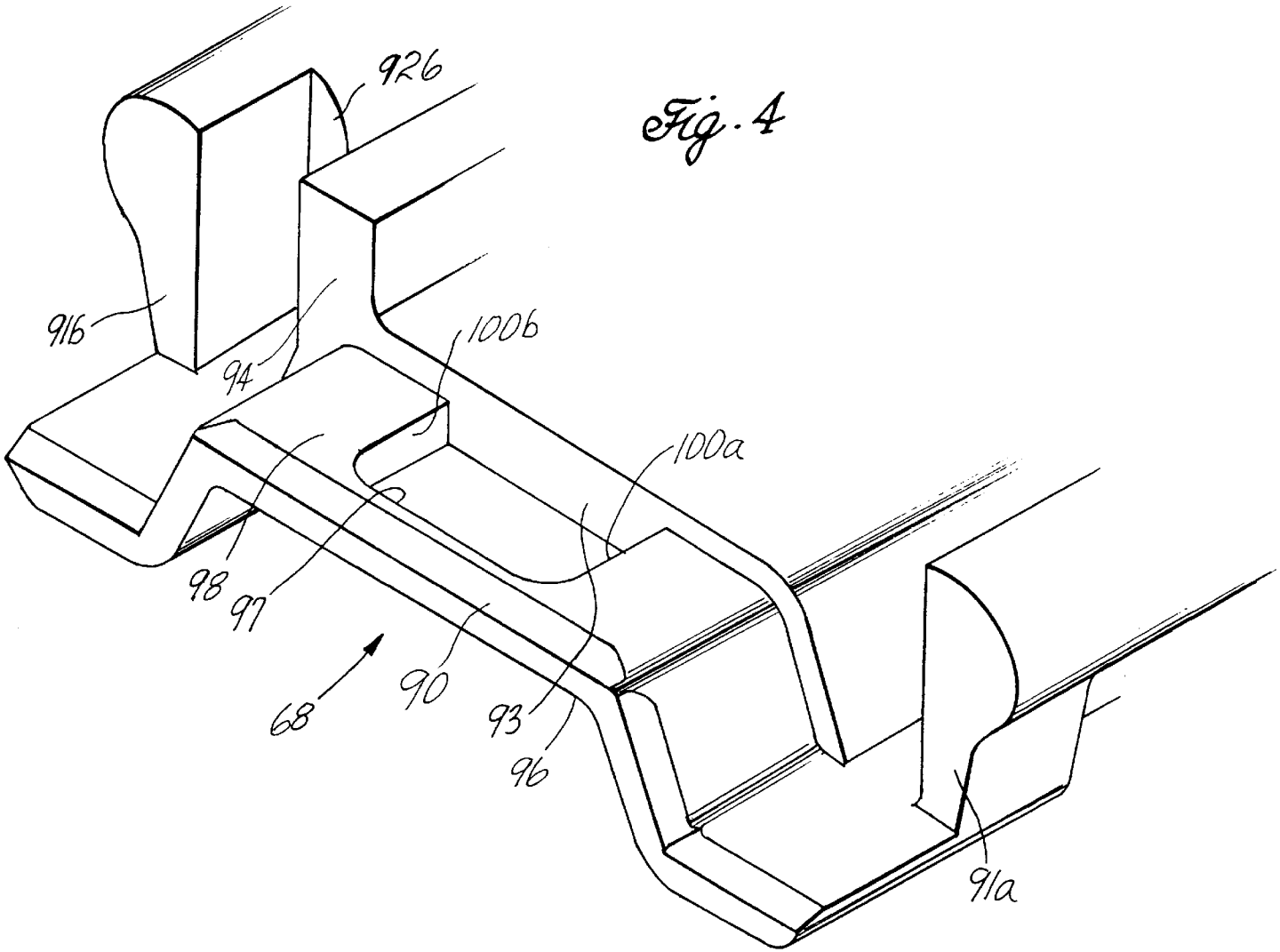
FIG. 4 is a perspective view of the guide block of FIG. 2.

FIG. 4 illustrates the guide block 68. As previously described, the guide block has a vertical web and upper and lower stops 91*a,b* horizontally extending from the upper and lower margins of the vertical web. The upper and lower stops 91*a,b* curve in a vertically outward direction to fill, respectively, the upper and lower vertically inwardly facing inner bearing raceways 27*a,b* of the intermediate slide member (as illustrated in FIG. 2). The stops 91*a,b* contact the upper and lower outer flanges 43*a,b,* and partially portions of the vertical web, of the bearing retainer, thereby halting movement of the bearing retainer 41 when the bearing retainer is moved towards the guide block 68.

The upper and lower stops 91*a,b* include an upper vertically inward curve 92*b* and a lower vertically inward curve 92*b.* The vertically inward curves guide the inner slide member as it is inserted into the outer or intermediate slide member by contacting the raceways 35*a,b* of the inner (assuming a two member slide) slide member. Additionally, a guide rail 94 extends horizontally from the guide block 68. As the inner slide member 31 is inserted, the guide rail contacts one of the horizontal arms of the inner slide member thereby limiting lateral movement of the inner slide member. Therefore, the stops 91*a,b,* in conjunction with the guide rail, assist in guiding the insertion of the inner slide member into the rest of the drawer slide.

The vertical web of the guide block 68 includes a lower surface 96 adapted for placement adjacent the outer slide member, and an upper surface 98. When the guide block is mounted to the outer slide member (for a two member slide) or intermediate slide member (for a three member slide) the upper surface is a distance from the outer (or intermediate) slide member insufficient to contact the connecting member 47 of the bearing retainer. The guide block also includes a front edge 90. The upper surface of the front edge 90 may be chamfered. Within the upper surface is a recess 67. The recess 67 is defined by a front face edge 97 vertically extending along the guide block and penetrating into the guide block. The recess 67 is terminated by a rear face surface 93. The rear face surface 93 vertically extends along the guide block. Side edge surfaces 100*a,b* form the sides of the recess 67, and connect the front face edge 97 to the rear surface 93. The volume defined by the side edge surfaces 100*a,b,* the front face edge 97, and the rear face surface 93 define the recess 67.

During normal operation of the drawer slide the protrusion is not positioned within the recess. Instead, the bearing retainer is limited in longitudinal movement to a position close to, but not abutting, the guide block. This configuration changes, however, when the inner slide member is removed from the other slide members. This removal, and its effects, is described below with respect to a two member slide.

The inner slide member is removed from the outer slide member by extending the inner slide member past the outer slide member. Extending the inner slide member past the outer slide member generally entails the use of some latching mechanism, and such latching mechanisms are well known in the art. When the inner slide member is extended past the outer slide member, the inner slide member drags, through the frictional forces resulting in the rolling engagement of the ball bearings, the bearing retainer further in the longitudinal direction than its normal extent of travel. This additional travel results in the protrusion in the bearing retainer being positioned in the recess.

The rear face surface 93 of the guide block limits movement of the bearing retainer towards the guide block by contact with the frontal edge 62 of the extending member 61. As previously described, the contact of the rounded protrusion edges 71*a,b* with the front face edge 97 of the recess 67 curtails movement of the bearing retainer 41 away from the guide block 68. A small amount of translational force applied to the bearing retainer 41 away from the guide block 68 disengages the loose engagement of the protrusion 63 with the recess 67. This small amount of translational force is applied when the inner slide member is reinserted into the outer slide member.

Figure 5:
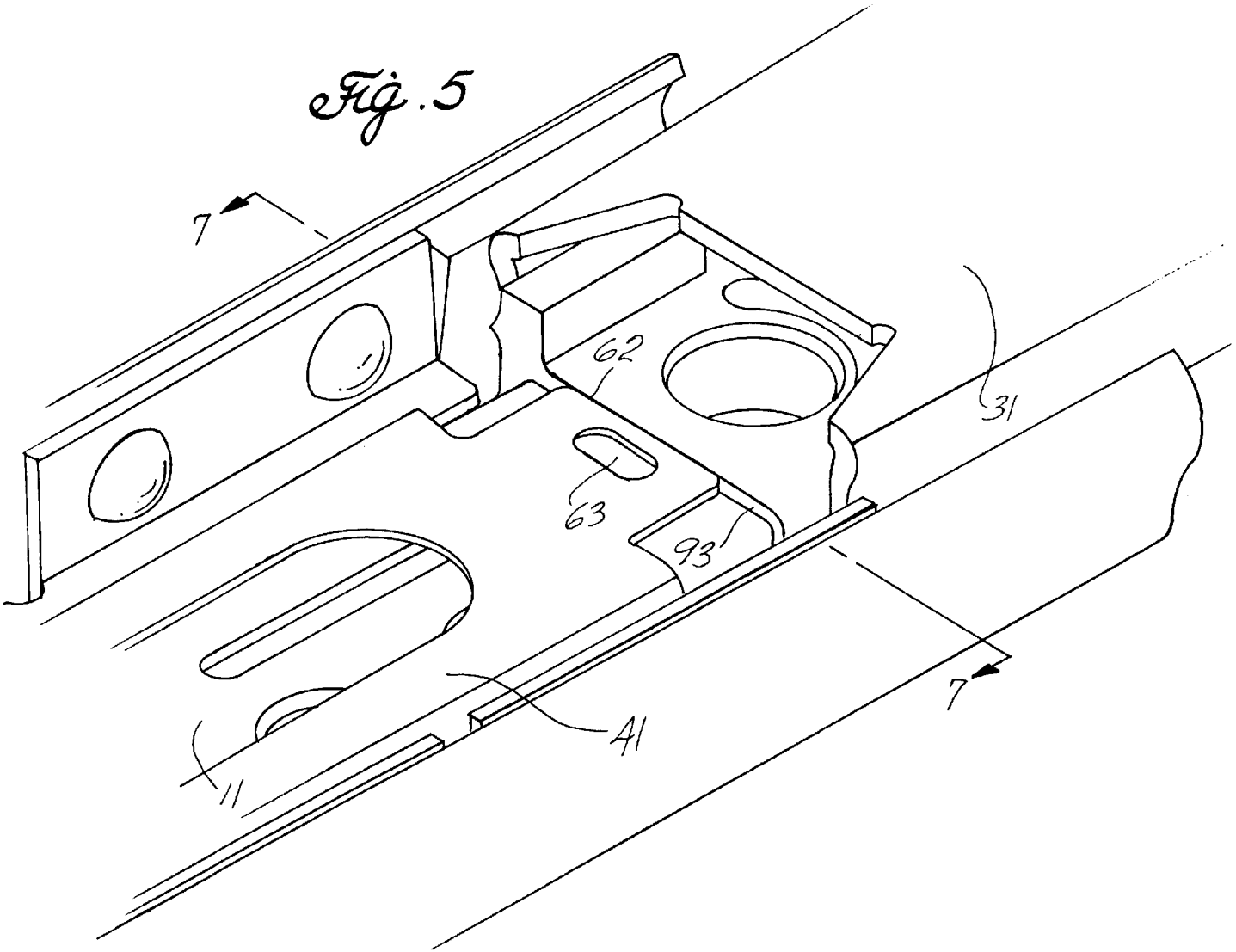
FIG. 5 is a perspective view of the drawer slide of FIG. 2 with the bearing retainer engaged with the guide block.

FIG. 5 illustrates a drawer slide with the bearing retainer 41 positioned so that the protrusion is within the recess of the guide block. The frontal edge 62 is in contact with the rear face surface 93 of the guide block. With the protrusion in the recess, apertures in the vertical web of the bearing retainer are aligned to expose screw holes in the outer slide member 11.

In the engaged position shown in FIG. 5, the protrusion is not in contact with the edges of the recess due to the recess being larger in dimension than the protrusion. Thus, some movement of the bearing retainer is possible, due to the recess being of a dimension larger than that of the protrusion. The result is that the protrusion is in loose fitting engagement allowing some movement of the bearing retainer, however, the bearing retainer is largely restricted due to the protrusion extending into the recess.

Figure 6:
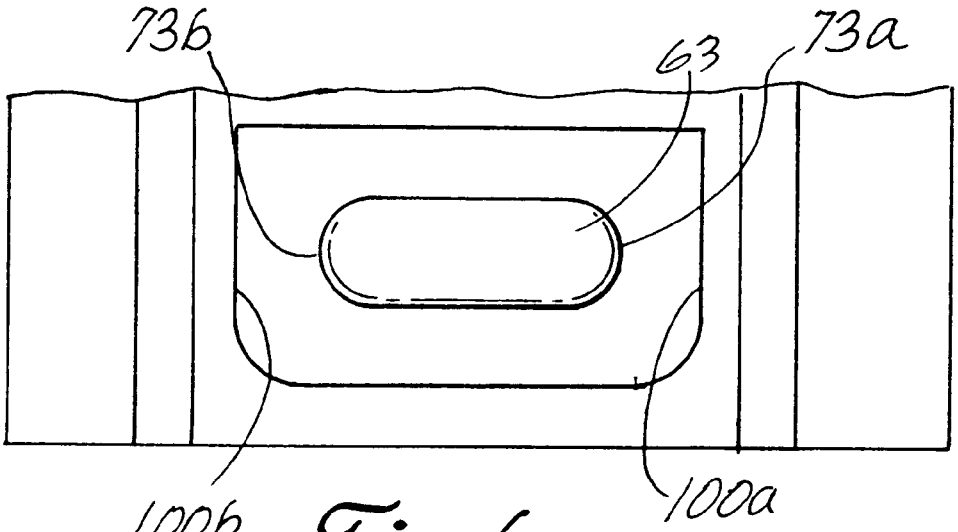
FIG. 6 is a cross-section view of a protrusion of the bearing retainer of FIG. 2 lodged in a recess of the guide block of FIG. 2.

FIG. 6 illustrates a bottom view of the protrusion engaged in the recess. The sides of the recess 100*a,b* are spaced a distance apart greater than the distance between the sides of the protrusion 73*a,b*. The protrusion is substantially centered in the recess, with the size of the protrusion equidistant from the sides of the recess 100*a,b*. Accordingly, the protrusion floats in the recess, with the protrusion providing some room for longitudinal movement, and, if necessary, latitudinal movement.

Figure 7:
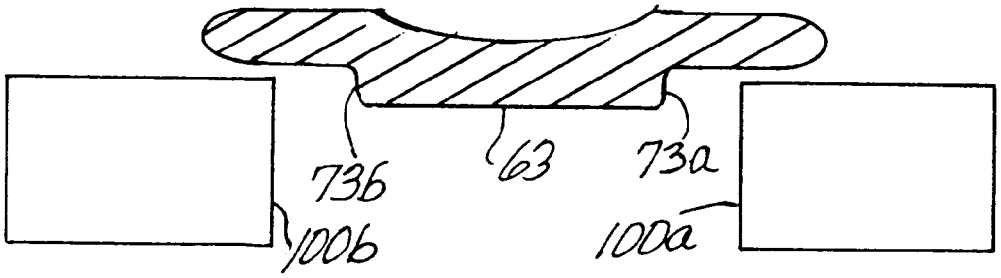
FIG. 7 is a bottom view of the protrusion of the bearing retainer of FIG. 2 lodged in the recess of the guide block of FIG. 2.

FIG. 7 illustrates a side-cross sectional view of the protrusion engaged in the recess. The protrusion is centered within the recess, with the sides of the protrusion 73*a,b,* equidistant from the sides of the recess 100*a,b*. Further, the bottom of the connecting member 47, which is the side of the connecting member adjacent to the guide block, is not in contact with the top of the guide block. This allows the bearing retainer to float while the protrusion is in the recess, without the guide block biasing or contacting, or engaging the connecting member. As illustrated in FIG. 7, the protrusion is formed by making a dimple in or by embossing the connecting member. Alternatively, the protrusion may be formed by forming a connecting member out of a single piece of thick material and machining away portions of the connecting member so as to form a protrusion, or by attaching or depositing material onto the connecting member.

Figure 8:
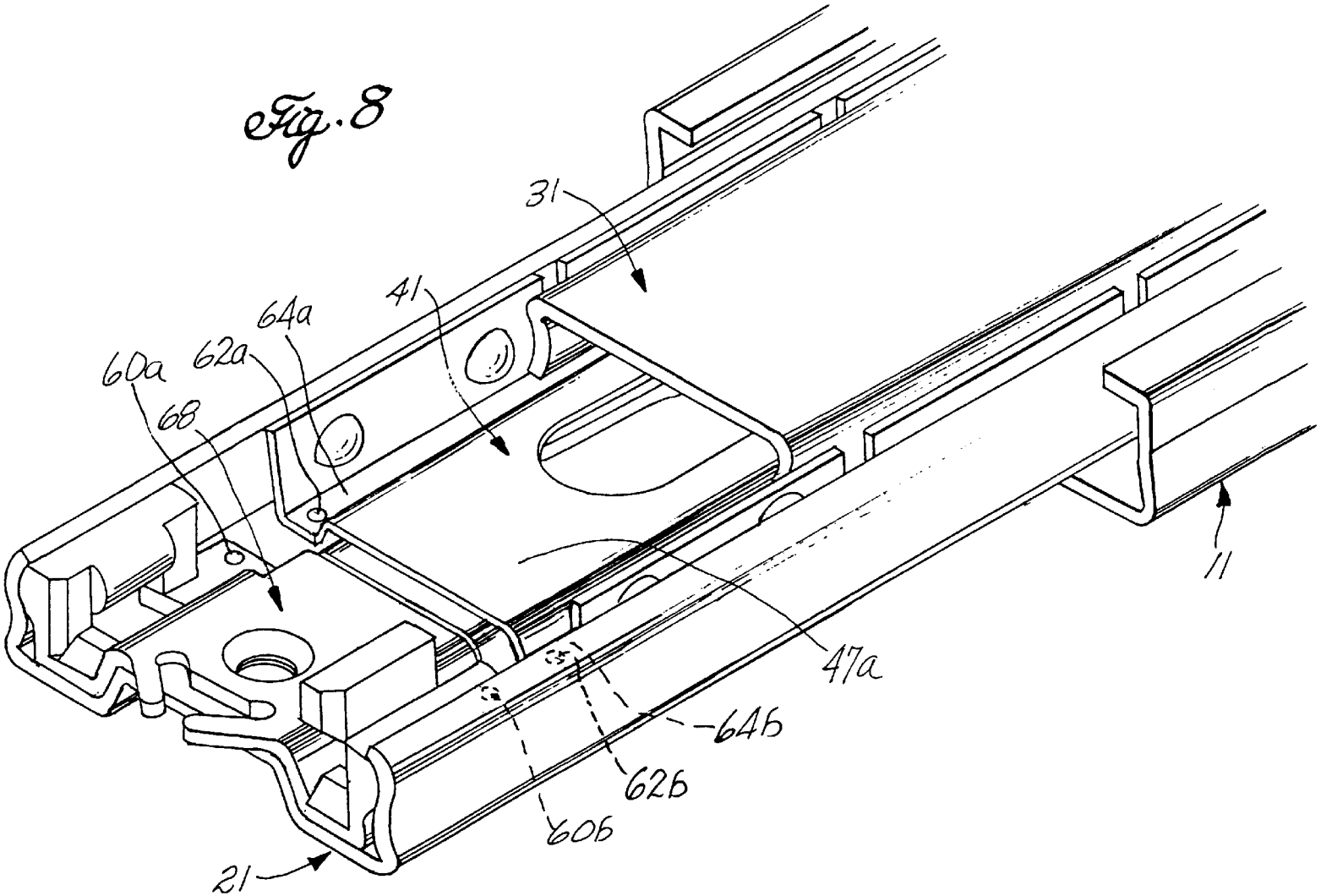
FIG. 8 is a perspective view of another embodiment of a drawer slide illustrating a bearing retainer and guide block of the present invention, with the bearing retainer proximate the guide block.

FIG. 8 illustrates an alternate embodiment of the present invention. In the alternative embodiment of FIG. 8, a drawer slide is shown with its various complements in the same relative position to one another as in the drawer slide illustrated in FIG. 2. In the drawer slide of FIG. 8, however, the bearing retainer 41 and guide block 68 are modified so as to place dual dimples and dual recesses in the bearing retainer and guide block, respectively, although one each of a dimple and recess could be used instead. More specifically, the web of the bearing retainer has a cross-sectional shape similar to that of a hat, with a topmost portion of the web 47*a* connected by sloping portions to two runners 64*a,b* which form opposing margins of the web. The upper and lower outer flanges of the bearing retainer extend perpendicular from the web at the opposing margins of the runners 64*a,b*. The bearing retainer of the slide of FIG. 8 does not include a connecting member, instead the dimples 62*a,b* are placed directly in the runners of the bearing retainer.

Runners of the guide block each also include a recess 60*a,b*. These recesses, slightly larger in dimension than the dimensions of the dimples on the bearing retainer, are adapted to receive the dimples in a loose fitting engagement.

Figure 9:
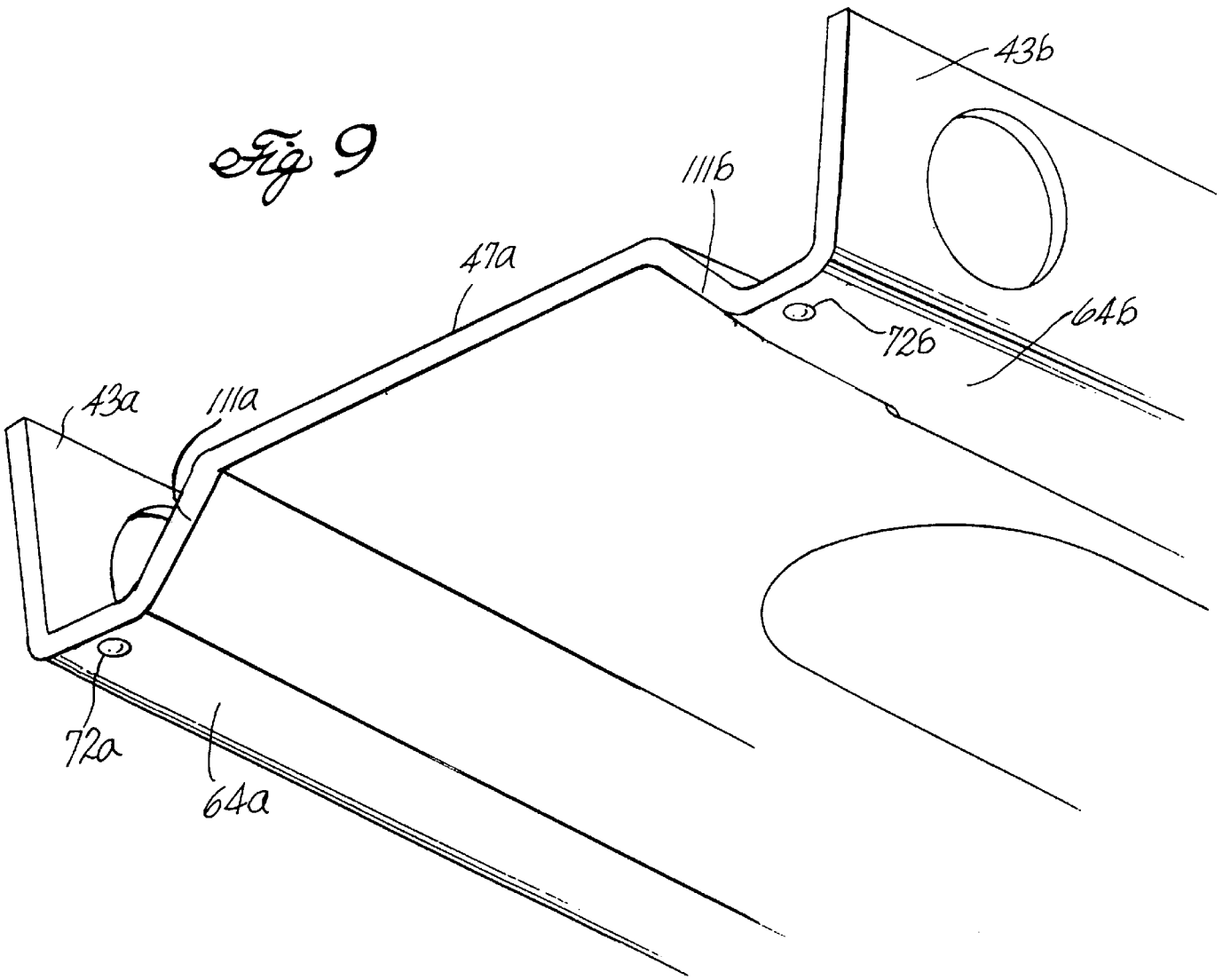
FIG. 9 is a perspective view of the bearing retainer of FIG. 8.

FIG. 9 illustrates a bearing retainer of the embodiment of FIG. 8. The bearing retainer of FIG. 9 has a topmost portion 47*a* with downsloping portions 111*a,b* leading to runners 64*a,b* on the bearing retainer. The upper and lower outer flanges extend substantially perpendicular from the runners. Close to one longitudinal end of the bearing retainer are dimples 72*a,b* placed within the area defined by the runners.

Figure 10:
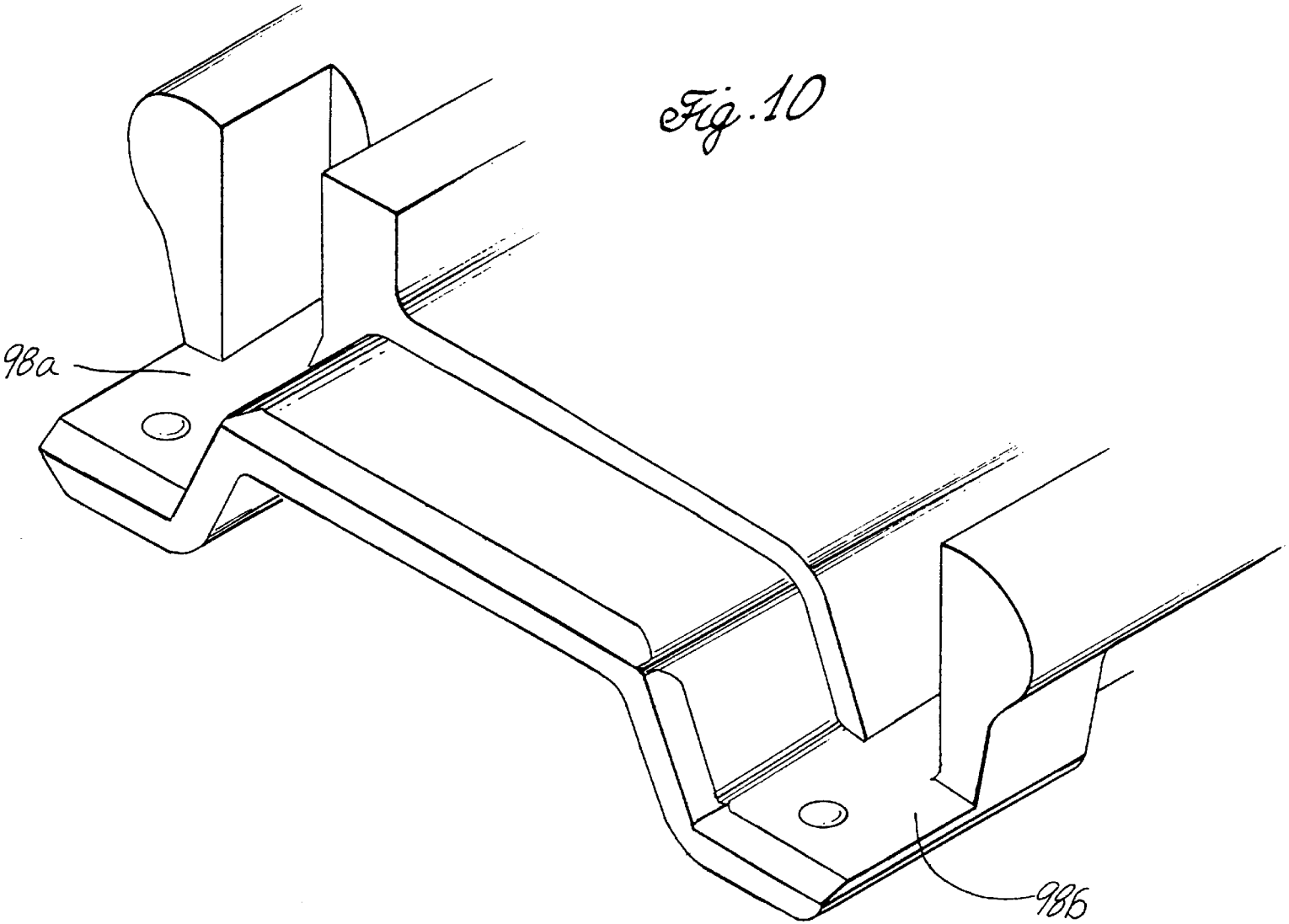
FIG. 10 is a perspective view of the guide block of FIG. 8.

FIG. 10 illustrates a guide block used with the alternative slide of FIG. 8. The guide block of FIG. 10 differs from the guide block of FIG. 4 in that recesses are placed in each of the runners 98*a,b* of the guide block instead of the middle of the guide block. Otherwise, the guide block of FIG. 10 is the same as the guide block of FIG. 4. Additionally, in order to save material or to further ensure that the bearing retainer does not inadvertently contact the guide block, material from the middle of the guide block may be removed.

FIG. 11 illustrates a bottom view of the guide block with the dimples placed within the recesses. The dimensions of the recesses are substantially larger than those of the dimples. Therefore, the edges of the dimples do not contact the edges of the recess. This provides a loose fitting engagement which allows for some movement of the bearing retainer when the dimples are within the recesses. Further, as illustrated in FIG. 12, a gap exists between the bearing retainer and the guide block such that the major portion of the topmost portion of the bearing retainer 41, the downsloping portions of the bearing retainer 111*a,b,* and the runners 64*a,b* of the bearing retainer 41 are not in contact with the topmost portion of the guide block, the downsloping portions of the guide block, or the runners of the guide block. Thus, the bearing retainer is not biased when the dimples are maintained within the recesses.

Accordingly, the present invention provides for a drawer slide with a bearing retainer restraint. Although this invention has been described in certain specific embodiments, many additional modifications and variations will be apparent to those skilled in the art. It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. A drawer slide comprising:

an inner slide member;

an outer slide member slidably connected to the inner slide member by a plurality of bearings so as to allow the inner slide member to longitudinally extend from the outer slide member;

a bearing retainer disposed between the inner slide member and the outer slide member, the bearing retainer having apertures holding the bearings in spaced relative position to one another, the bearing retainer comprising a web formed of a top portion, two runners substantially parallel to the top portion, two sloped portions, each of the sloped portions connecting one of the runners with the top portion, and flanges extending substantially perpendicularly from the runners, the flanges having the apertures holding the bearings, and a protrusion of a first dimension extends from one of the runner; and a guide block affixed to the outer slide member, the guide block having a recess of a second dimension, the second dimension being greater than the first dimension such that the protrusion does not contact the block when the recess receives the protrusion, the recess being adapted to receive the protrusion when the inner slide member is longitudinally withdrawn from the outer slide member.

2. The drawer slide of claim 1 wherein the bearing retainer web comprising the top portion, the runners, and the sloped portions, and the flanges do not contact the guide block when the recess receives the protrusion.

3. The drawer slide of claim 1 further comprising a stop block extending from the guide block, the stop block extending horizontally behind the recess of the guide block closest to the end of the outer slide member, the stop block being of size and shape that the vertical web of the bearing retainer contacts the stop block when the bearing retainer is moved towards the guide block.

4. The drawer slide of claim 1 wherein the protrusion on the bearing retainer further comprises:

rounded edges and being of a similar but smaller size than the recess in the guide block.

5. A drawer slide comprising:

an inner slide member having an inner member vertical web and upper and lower arms forming upper and lower vertically outward facing bearing raceways extending generally horizontally from the upper and lower margins, respectively, of the inner member vertical web;

an outer slide member having an outer member vertical web and upper and lower arms forming upper and lower vertically inward facing bearing raceways extending generally horizontally from the upper and lower margins, respectively, of the outer member vertical web;

a plurality of upper bearings in rolling engagement with the upper vertically inward facing and upper vertically outward facing bearing raceways;

a plurality of lower bearings in rolling engagement with the lower vertically inward facing and lower vertically outward facing bearing raceways;

a bearing retainer having an upper flange, a lower flange, a connecting member, and upper and lower runners connecting the upper flange and the lower flange to the connecting member, the connecting member having at least a portion forming a vertical web, with the upper bearings disposed in apertures in the upper flange and the lower bearings disposed in apertures in the lower flange, the upper and lower runners including upper and lower protrusions; and a guide block affixed to the outer member vertical web of the outer slide member, the guide block including upper and lower recesses adapted to receive the upper and lower protrusions in loose fitting engagement.

6. A drawer slide comprising:

an inner slide member having an inner member vertical web and upper and lower arms forming upper and lower vertically outward facing inner slide bearing raceways extending generally horizontally from the upper and lower margins, respectively, of the inner member vertical web;

an outer slide member having an outer member vertical web and upper and lower arms extending generally horizontally from the upper and lower margins of the outer member vertical web;

an intermediate slide member having an intermediate member vertical web and upper and lower arms extending generally horizontally from the upper and lower margins, respectively, of the intermediate member vertical web, the upper arm forming an upper vertically outward facing bearing raceway and upper vertically inward facing bearing raceway, and the lower arm forming a lower vertically outward facing bearing raceway and lower vertically inward facing bearing raceway;

a plurality of upper and lower outer bearings in rolling engagement, respectively, with the upper and lower bearing raceways of the outer slide member and the upper and lower vertically outward facing outer bearing raceways of the intermediate slide member;

a plurality of upper and lower inner bearings in rolling engagement, respectively, with the upper and lower vertically outwardly facing inner bearing raceways of the inner slide and the upper and lower vertically inwardly facing inner bearing raceways of the intermediate slide member;

a bearing retainer having an upper flange, a lower flange, a connecting member, and upper and lower runners connecting the upper flange and the lower flange to the connecting member, the connecting member having at least a portion forming a vertical web, with the upper inner bearings disposed in apertures in the upper flange and the lower inner bearings disposed in apertures in the lower flange, the upper and lower runners including upper and lower protrusions; and a guide block affixed to the intermediate member vertical web of the intermediate slide member, the guide block including upper and lower recesses adapted to receive the upper and lower protrusions in loose fitting engagement.

7. The drawer slide of claim 6 wherein the guide block further comprises:

a pair of upper and lower stops extending horizontally from the guide block vertically outwardly curved to contact and fill, respectively, the upper and lower vertical inwardly facing inner bearing raceways of the intermediate slide member, to contact the horizontal arms of the bearing retainers when the bearing retainer is moved towards the guide block, the upper and lower stops vertically inwardly curved to contact, respectively, the upper and lower vertical outwardly facing raceways of the inner slide member to guide the inner slide member upon insertion into the drawer slide.

8. The drawer slide of claim 6 wherein the guide block comprises:

an upper receiver and a lower receiver containing the upper and lower recesses adapted to receive the upper and lower protrusions on the bearing retainer.

9. The drawer slide of claim 6 wherein the upper and lower protrusions on the bearing retainer further comprises:

rounded edges and being of a similar but smaller size than the upper and lower recesses in the guide block.

* * * * *

UNITED STATES PATENT AND TRADEMARK OFFICE

CERTIFICATE OF CORRECTION

PATENT NO. : 6,145,945
DATED : November 14, 2000
INVENTOR(S) : Jackie D. Parvin

It is certified that error appears in the above-identified patent and that said Letters Patent is hereby corrected as shown below:

Column 8,
Line 51, change "runner" to -- runners --.

Signed and Sealed this

Fourth Day of June, 2002

*Attest:*

*Attesting Officer*

JAMES E. ROGAN
*Director of the United States Patent and Trademark Office*